US005153657A

United States Patent [19]

Yu et al.

[11] Patent Number: 5,153,657

[45] Date of Patent: Oct. 6, 1992

[54] CLEANING BLADE WEAR LIFE EXTENSION BY INORGANIC FILLERS REINFORCEMENT

[75] Inventors: Robert C. U. Yu, Webster; Nero R. Lindblad, Ontario, both of N.Y.

[73] Assignee: Xerox Corporation, Stamford, Conn.

[21] Appl. No.: 693,104

[22] Filed: Apr. 29, 1991

[51] Int. Cl.[5] ..... G03G 21/00

[52] U.S. Cl. ..... 355/299; 15/256.5

[58] Field of Search ..... 355/299; 118/652; 15/256.5, 256.51; 428/908.8

[56] References Cited

U.S. PATENT DOCUMENTS

| | | | |
|---|---|---|---|
| 2,767,529 | 10/1956 | Scott | 51/204 |
| 3,635,556 | 1/1972 | Levy | 355/217 |
| 3,915,735 | 10/1975 | Moreland | 106/308 |
| 4,549,933 | 10/1985 | Judd et al. | 162/281 |
| 4,823,161 | 4/1989 | Yamada et al. | 355/299 |
| 4,825,249 | 4/1989 | Oki et al. | 355/299 |
| 4,984,326 | 1/1991 | Horie et al. | 15/256.5 |
| 5,039,575 | 8/1991 | Mori et al. | 428/908.8 X |

FOREIGN PATENT DOCUMENTS

| | | | |
|---|---|---|---|
| 58-203480 | 11/1983 | Japan | 355/299 |

OTHER PUBLICATIONS

Xerox Disclosure Journal "Impregnated Poromeric Material Cleaning Blade", vol. 1, No. 4, Apr. 1976, p. 79, Spencer, Paul R., et al.

"Nylon Fiber Reinforcement for Polyurethane Composites," Polymer Composites, Cordova et al., vol. 8, No. 4, Aug. 1987, pp. 253-255.

*Primary Examiner*—Joan H. Pendegrass

[57] ABSTRACT

A cleaning blade which is made from an elastomeric matrix having inorganic particulates homogenously dispersed therein. The cleaning blade is used in an electrophotographic printing machine to remove residual particles from a photoconductive imaging member surface.

9 Claims, 4 Drawing Sheets

CLEANING BLADE WEAR LIFE EXTENSION BY INORGANIC FILLERS REINFORCEMENT

BACKGROUND OF THE INVENTION

This invention relates generally to electrophotographic printing, and more particularly, a cleaning blade used therein to remove particles adhering to the photoconductive member.

In the process of electrophotographic printing, a photoconductive surface is charged to a substantially uniform potential. The photoconductive surface is imagewise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a sheet of support material and permanently affixed thereto.

This process is well known and useful for light lens copying from an original and printing applications from electronically generated or stored originals, and in ionography.

In a reproduction process of the type as described above, it is inevitable that some residual toner will remain on the photoconductive surface after the toner image has been transferred to the sheet of support material (e.g. paper). It has been found that with such a process that the forces holding some of the toner particles to the imaging surface are stronger than the transfer forces and, therefore, some of the particles remain on the surface after transfer of the toner image. In addition to the residual toner, other particles, such as paper debris (i.e. Kaolin, fibers, clay), additives and plastic, are left behind on the surface after image transfer. (Hereinafter, the term "residual particles" encompasses residual toner and other residual particles remaining after image transfer.) The residual particles adhere firmly to the surface and must be removed prior to the next printing cycle to avoid its interfering with recording a new latent image thereon.

Various methods and apparatus may be used for removing residual particles from the photoconductive imaging surface. Hereinbefore, a cleaning brush, a cleaning web and a cleaning blade have been used. Both cleaning brushes and cleaning webs operate by wiping the surface so as to affect transfer of the residual particles from the imaging surface thereon. After prolonged usage, however, both of these types of cleaning devices become contaminated with toner and must be replaced. This requires discarding the dirty cleaning devices. In high-speed machines this practice has proven not only to be wasteful but also expensive.

The shortcomings of the brush and web made way for another now prevalent form of cleaning known and disclosed in the art of blade cleaning. Blade cleaning involves a blade, normally made of a rubberlike material (e.g. polyurethane) which is dragged or wiped across the surface to remove the residual particles from the surface. Blade cleaning is a highly desirable method, compared to other methods, for removing residual particles due to its simple, inexpensive structure. However, there are certain deficiencies in blade cleaning, which are primarily a result of the frictional sealing contact that must occur between the blade and the surface.

Dynamic friction is the force that resists relative motion between two bodies that come into contact with each other while having separate motion. This friction between the blade edge and the surface causes wearing away of the blade edge, and damages the blade's contact with the surface. For purposes of this application, volume wear (W) is proportional to the load (F) multiplied by the distance (D) traveled. Thus, $W \propto FD \propto FVT$, or introducing a factor of proportionality K, $W=KFVT$ where K is the wear factor, V is the velocity and T is the elapsed time. Hence, wear increases with larger values of K. Various blade lubricating materials or toner lubricant additives have been proposed to reduce friction which would thereby reduce wear. However, lubricants tend to change the operational characteristics of the printing machine undesirably. For example, a polyurethane blade with a good lubricant in the toner can ideally achieve a frictional coefficient of about 0.5, however, this rarely occurs because of the delicate balance involved in achieving the proper weight percent of lubricant in the toner. Normal frictional coefficient values for cleaning blades that remove toner off the imaging surface range from a low of about 0.5 to a high of about 1.5.

In addition to the problem of wear, which is more or less predictable over time, blades are also subject to unpredictable failures. The impact from carrier beads remaining on the charge retentive surface subsequent to development may damage the blade, and sudden localized increases in friction between the blade and surface may cause the phenomenon of tucking, where the blade cleaning edge becomes tucked underneath the blade, losing the frictional sealing relationship required for blade cleaning. Additionally, slight damage to the contacting edge of the blade appears to eventually initiate tearing sites. These problems require removal and replacement of the blade. It is an objective of the present invention to provide a cleaning blade member which exhibits improved blade tip tear resistance.

Investigation into the characteristic of cleaning blade performance has shown that lateral conformance of the blade, i.e., conformance of the blade across the imaging surface, is generally given by $$\epsilon \propto 1/E$$

where $\epsilon$ is blade conformance in microns;

E is the Young's modulus for a given elastomer.

A high value for lateral conformance is very desirable, and accordingly, for a given blade, Young's modulus should be small.

It has also been determined that for the blade to optimally respond to roughness in the imaging surface, particularly at high speeds, the resonant frequency of the blade must be as high as possible. Resonant frequency of a blade is given by $$\omega_0 \propto \sqrt{E}$$

where $\omega_0$ is the resonant frequency of the blade.

A high resonant frequency for optimal frequency response is very desirable, and accordingly, for a given blade, Young's modulus for the selected elastomer should be large.

It can be seen that the use of isotropic materials, such as the urethane cleaning blades currently used in electrophotographic cleaning processes, requires a trade off in the selection of materials having a Young's modulus that satisfactorily meets both the lateral conformability requirement, and the resonant frequency requirements.

The commonly used elastomer-type cleaning blade is a resilient material that allows stubborn residual particles to remain on the surface. This occurs because the resilient elastomeric material is unable to provide sufficient contact to create a tight seal between the cleaning blade and the surface when tuck occurs, therefore the resiliency of the elastomeric blade makes it easy for the blade to glide over the residual particles.

One approach to increase cleaning blade life is to improve the blade wear rate. The physical and geometrical changes observed in a blade due to wear is believed to be one of the key elements that causes the blade to lose its cleaning efficiency. Since this poor service wear life can lead to frequent blade replacements, it is therefore, very costly and taxes our customer service system as well. It is an object of this invention to improve the wear life and durability thus reducing blade replacements.

While it might appear that a rigid metal blade might solve the problems of rigidity and wear, in fact, the frictional contact required between the surface and blade quickly wears away the blade and any surface lubricants applied thereto. As the blade edge wears, it changes from a chiseling edge to a rounded or flattened surface which requires a high force to maintain the edge in sealing contact. While a beveled edge is useful in liquid toner applications, it is highly susceptible to damage and wear in dry toner applications. Accordingly, it is desirable to maintain the blade's square edge without wear. Additionally, wearing friction may generate toner fusing temperatures, causing toner to fuse to the blade, or the surface. Furthermore, filming on the surface can deteriorate image quality. Filming occurs either uniformly or as streaking, due to deficiencies in blade cleaning, requiring the use of a lubricant and a balancing abrasion element to prevent filming. It is an object of the present invention to reduce the frictional contact between a cleaning blade and an imaging surface.

Further objectives of the present invention include: providing a cleaning blade member with improved resistance to fatigue cracking; and providing a cleaning blade member having substantial mechanical stability and extended service life.

Various cleaning techniques have hereinbefore been used as illustrated by the following disclosures, which may be relevant to certain aspects of the present invention:

"Impregnated Poromeric Material Cleaning Blade," Xerox Disclosure Journal, et al., Vol. 1, No. 4, April 1976, p. 79 describes a cleaning blade composition of non-woven polyester fibers bound together in polyurethane, for the improvement of abrasion resistance, hardness, resilience, and load bearing capacity.

"Nylon Fiber Reinforcement for Polyurethane Composites," Polymer Composites, Cordova et al., Vol. 8, No. 4, August 1987, pp..253–255, suggest polyurethane thermoset material with a nylon fiber filler for improved impact strength, impact fatigue and decreased stress cracking.

U.S. Pat. No. 2,767,529 to Scott describes a doctor blade for paper making machines made of metal or layers of fabric bonded together by synthetic resin.

U.S. Pat. No. 3,635,556 to Levy suggest a backing pad made of a carbon filled plastic foam material.

U.S. Pat. No. 3,915,735 to Moreland describes a monomeric silane sprayed or poured onto microcrystalline novaculite while it is being agitated in a high intensity mixing apparatus at a temperature between 70° F. and 350° F., and the monomeric silane and microcrystalline novaculite are allowed to remain in situ at a temperature between about 70° F. and 350° F. for at least about 1 minute.

U.S. Pat. No. 4,549,933 to Judd et al. describes a composite doctor blade with nonhomogeneous stiffness properties and having a plurality of juxtaposed fibrous layers which are encapsulated in an epoxy resin. The composite blade has a fibrous core, intermediate uni-directional graphite layers and outer fibrous layers. The uni-directional graphite fibers in the intermediate layers are oriented in the machine direction.

U.S. Pat. No. 4,823,161 to Yamada et al. describes a cleaning blade design which has a double-layer structure comprising a contact member first layer made of a poly(urethane) ureamide polymer, held in contact with a toner image bearing member surface, and a supporting member second layer adhered to the contact member first layer to provide improved blade function. The support member for the contact member has the same hardness or essentially the same hardness as the contact member and is lower than the contact member in glass transition temperature.

U.S. Pat. No. 4,825,249 to Oki et al. describes a cleaning blade for a photoelectronic copy machine comprising a substrate of urethane rubber and a coating of perflouropolyether.

SUMMARY OF THE INVENTION

Briefly stated, and in accordance with the present invention, there is provided a cleaning blade in frictional engagement with a surface and being adapted to remove particles from the surface. The cleaning blade includes a blade body made from a matrix material and particulate filler material that is combined with the blade body material.

BRIEF DESCRIPTION OF THE DRAWINGS

Other features of the present invention will become apparent as the following description proceeds and upon reference to the drawing, in which.

While the present invention will be described in connection with a preferred embodiment, thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
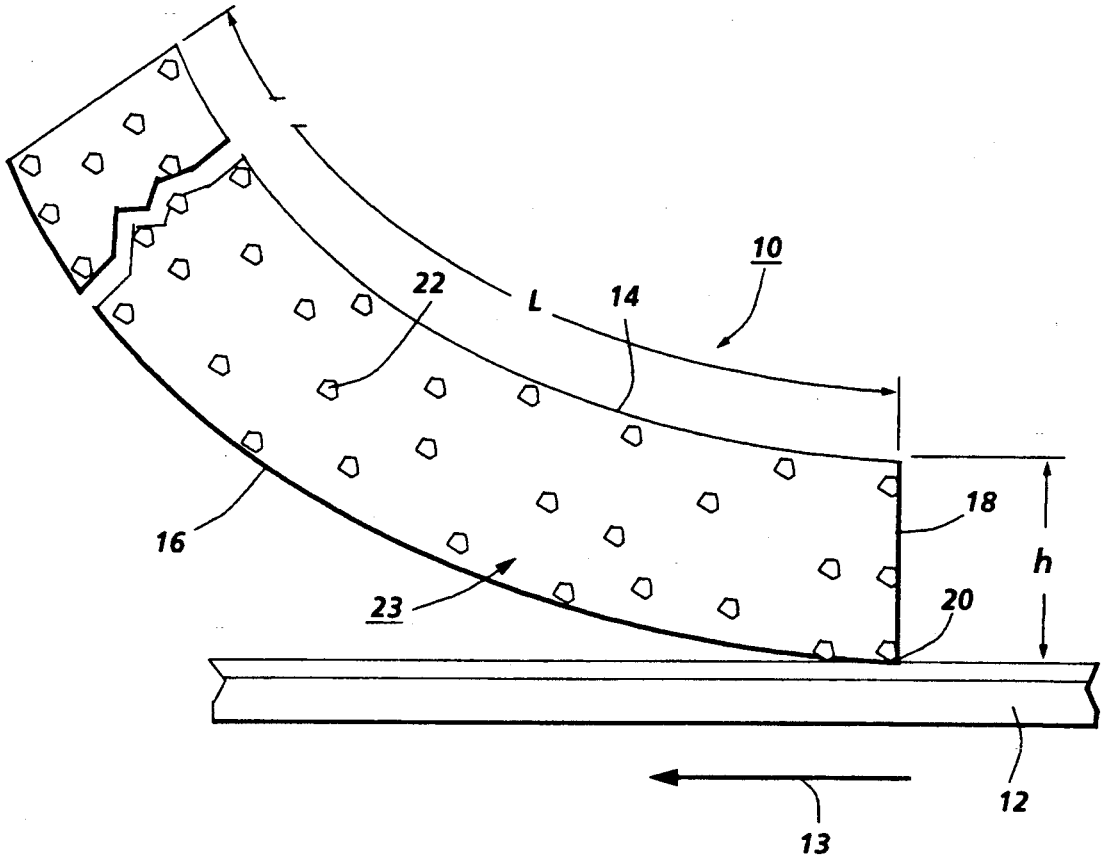
FIG. 1 is a cross-sectional view of a cleaning blade showing particle reinforcement.

With reference now to the drawings where the showings are for the purpose of illustrating a preferred embodiment of the invention and not for limiting same, FIG. 1 shows a schematic view of an elastomeric cleaning blade with particle reinforcement, in accordance with the invention which depicts schematically the various components thereof. Hereinafter, like reference numerals will be employed throughout to designate identical elements. Although the cleaning apparatus of the present invention is particularly well adapted for use in an electrophotographic printing machine, it should become evident from the following discussion that it is equally well suited for use in a wide variety of devices and is not necessarily limited to the particular embodiments shown herein.

Referring now to FIG. 1, which is a cross-sectional view of a cleaning blade having particle reinforcement. As illustrated in FIG. 1, blade 10, for cleaning an imaging surface of an electrophotographic image member 12 moving in the direction 13, is provided with upper and lower blade surfaces 14 and 16, having a length L, front face 18 and a height h. The inorganic particles of the invention 22 are homogeneously dispersed in the blade matrix 23. The dispersion of the inorganic particles 22 strengthen the blade 10. In combination with the lower surface 16, front face 18 forms cleaning edge 20 which is in cleaning contact with the electrophotographic imaging member 12. The blade supporting member, which supports the blade in frictional engagement with the imaging member 12 during cleaning process, is not shown in the figure. The blade 10 and the cleaning edge 20 extend across the entire width of imaging member 12, and transverse to the direction of the imaging member movement.

The cleaning blade is prepared from an elastomeric material with its matrix filled with inorganic particles for reinforcement. A variety of filler types may be used either along or in combination.

The fillers chosen for the present invention are inorganic fillers. These fillers are selected for suitable dispersion in the blade material matrix because they are easily dispersed by conventional solution mixing technique and resulting no particle agglomeration in the fabricated cleaning blade. An inorganic filler of particular interest is microcrystalline silica, a naturally occurring irregular shape quartz particle. Microcrystalline silica also exists in two other forms (christobalite and tridymite). The microcrystalline silica of the present invention has a Moh Hardness Number of about 7 with excellent inherent abrasion resistance. Other particulates of silica derivatives, such as micron size ground glass and micron size synthetic glass spheres are also good inorganic fillers for cleaning blade incorporation. Alternatively, spherical shape ceramic particles, such as zeeospheres, are good filler candidates for present invention application.

Figure 2:
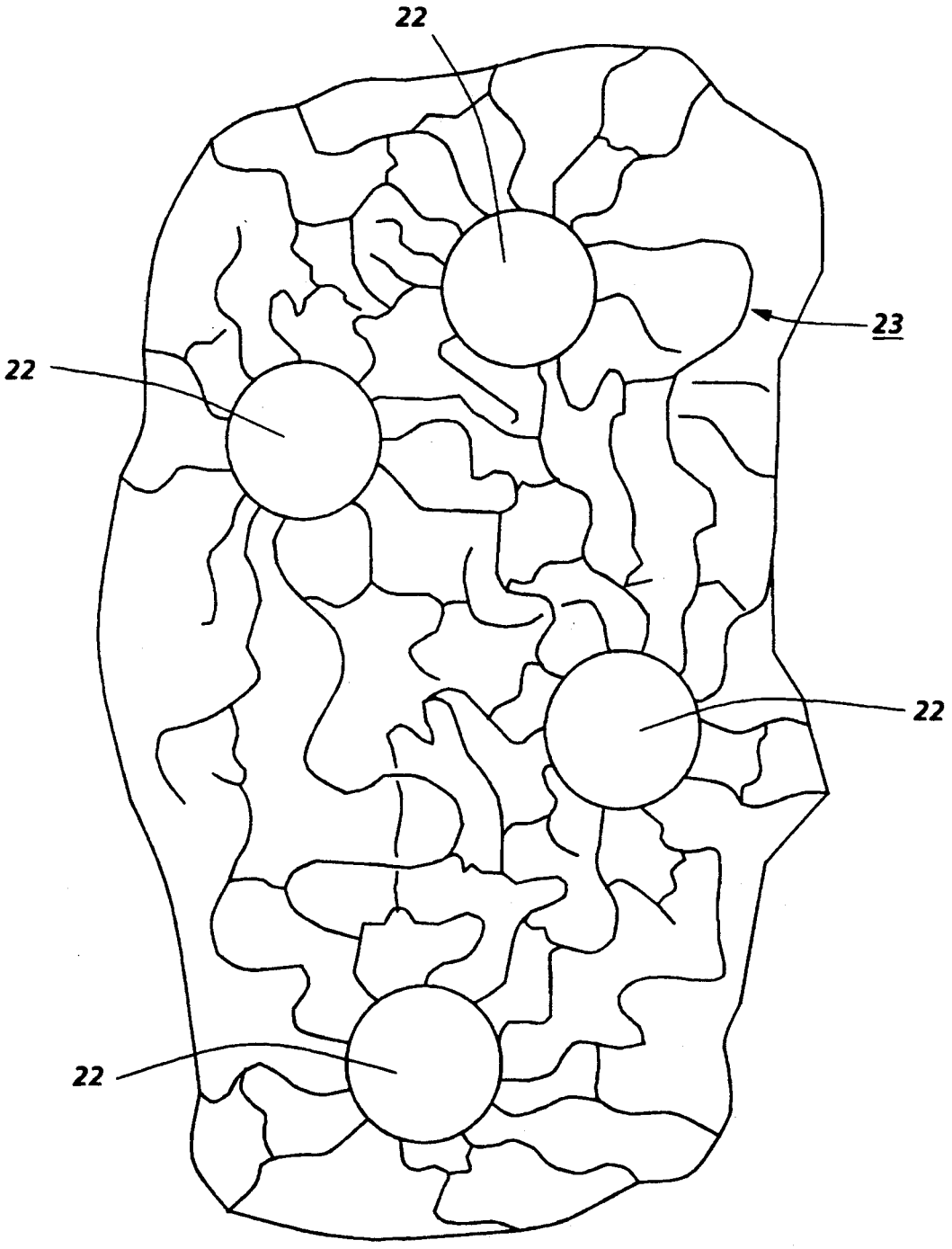
FIG. 2 is a schematic presentation of a filler reinforced polyurethane cross-linked network.

Referring now to FIG. 2, which shows an elastomeric matrix 23 with particulate filler 22 combined to create a reinforced material.

Figure 4:
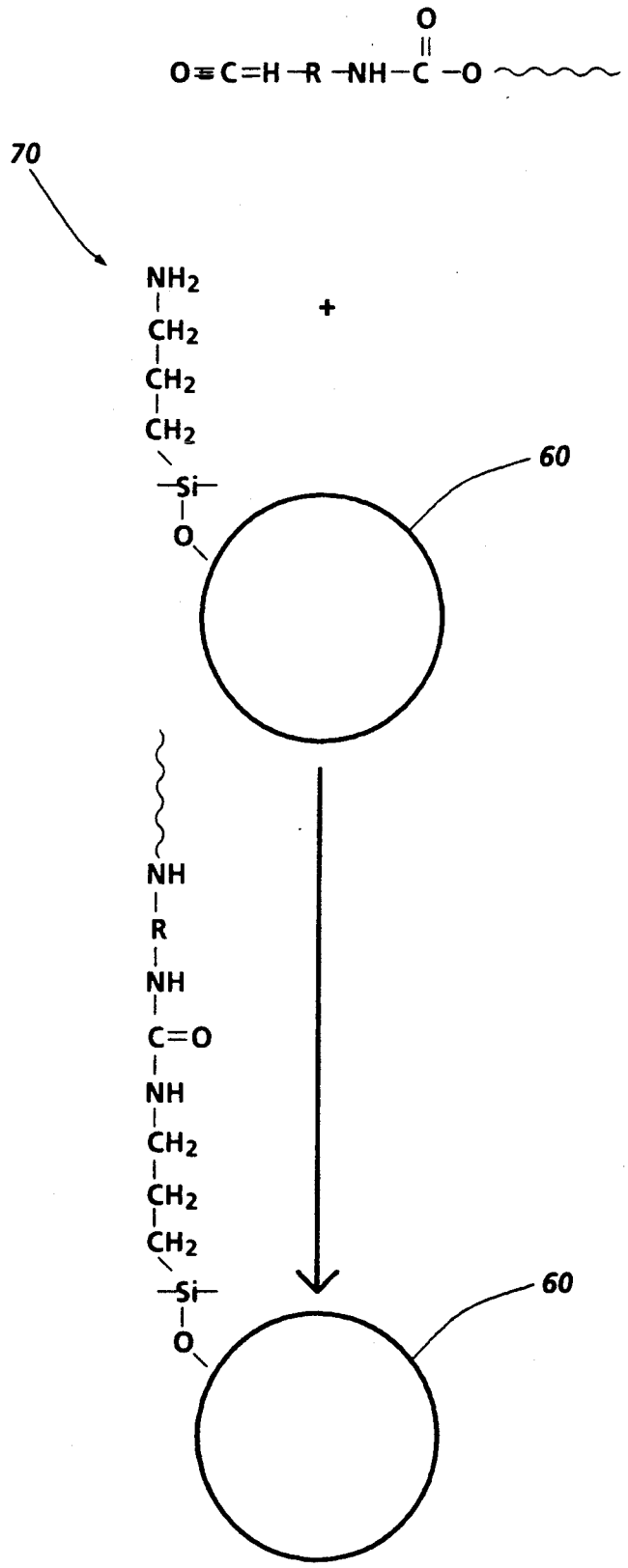
FIG. 4 is a schematic of 3-amino propyltriethoxy silane surface treated silica and polyurethane interaction.
Figure 3:
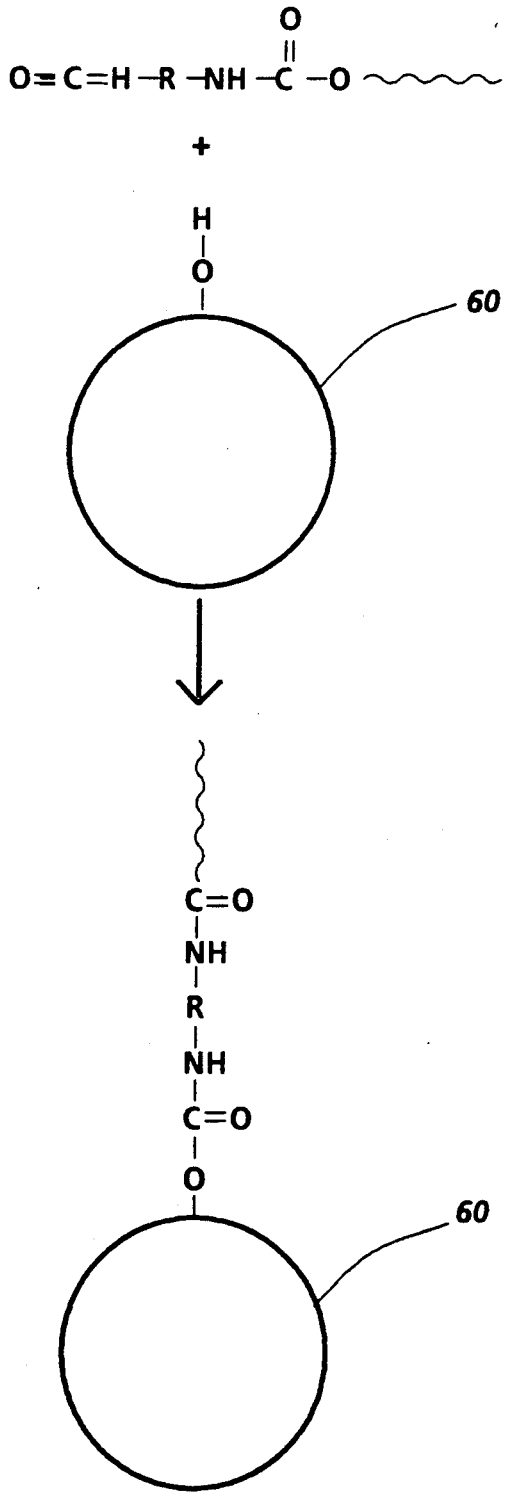
FIG. 3 is a schematic presentation of a silica particulate and a polyurethane molecule bonding.

Referring now to FIG. 3, which shows the molecular bonding of a polymer to a filler particles, in this case silica 60 and polyurethane interaction, to obtain a reinforced material as shown in FIG. 2. A way to improve filler-polymer interaction is by use of coupling agents. An example of such interaction is the microcrystalline silica particles may be surface treated with a bifunctional silane coupling agent 70 as shown in FIG. 4. The silane coupling agents of interest for particle surface treatment are: Chloropropyl triethoxy silane, having a molecular formula $Cl\ (CH_2)_3\text{-}Si\ (OC_2H_5)_3$; azido silane, having a molecular formula:

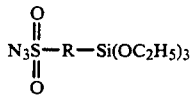

3-aminopropyltriethoxy silane, having a molecular formula $NH_2(CH_2)_3—Si\text{-}(OC_2H_5)_3$; N-(2-aminoethyl)-3-aminopropyltriethoxy silane, having a molecular formula $NH_2CH_2CH_2NH(CH_2)_3—Si\text{-}(OC_2H_5)_3$; 3-glycidoxypropyltriethoxy silane, having a molecular formula

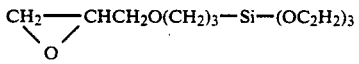

and the like. These silanes are employed in hydrolyzed forms because the OH groups of the hydrolyzed silanes readily react with the silanol functional groups of the microcrystalline silica surfaces and condense to form siloxane bonds at elevated temperature. The condensation reaction between the OH and silanol groups will position the siloxane at the surfaces of the silica particles and orient the organofunctional group of the silane outward to interact with the polymer molecules of the elastomer. The silane-polymer interaction is expected to produce the desired filler reinforcement effect.

The hydrolyzed silane solution which may be utilized to treat the microcrystalline silica may be prepared by hydrolyzing the alkoxy groups of a silane in an excess amount of water to form a dilute aqueous solution having about 0.1 weight percent to about 5.0 weight percent silane. A solution pH between about 9 and 13 is preferred. The control of the pH of the hydrolyzed silane solution may be achieved by acetic acid or hydrogen iodide addition. The silane microcrystalline silica surface treatment may be effected by washing the silica particles in the dilute hydrolyzed silane solution for about 1 minute to about 30 minutes. The resulting silica particles are filtered with a filter paper and dried at 135° C. in an oven for about 30 minutes to complete the silane surface treatment process. Alternatively, hydrolysis of the silane and surface treatment may also be effected directly at the surfaces of the microcrystalline silica particles as described, for example, in Example 2 of U.S. Pat. No. 3,915,735.

Other surface treatment coupling agents of value and suitable for present invention application are the organic titanates. They include:

(1.) Organic Titanates a. Tetra alkyl titanates which can be represented by the molecular structure $Ti\ (OR)_4$. Typical alkyl titanates are tetraisopropyl titanate, having a molecular formula $Ti\ (OC_3H_7)_4$; tetra-n-butyl titanate having a molecular formula $Ti\ (OC_4H_9)_4$; and tetrakis (2-ethyl hexyl) titanate, having a molecular formula $Ti(OCH_2CHC_4H9)_4$
|
$C_2H_5$ b. Titanate chalates which are represented by the general molecular structure

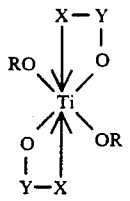

in which X represents a functional group containing oxygen or nitrogen and Y represents a two- or three-carbon chain.

(2.) Organic Zirconates

Typical neoalkoxy zirconates are tris(ethylene diamino) ethyl zirconate having a molecular formula $RO—Zr(0—C_2H_4—NH—C_2H_4\text{-}NH_2)_3$; and tris(m-amino)phenyl zirconate having a molecular formula $RO—Zr(0C_6H_4—NH_2)_3$ (3.) Organic Aluminates Other micrometer size inorganic fillers having high hardness and exceptional wear resisting properties include, for example:

Fine glass spheres in polyurethane. The glass spheres are amorphous synthetic glass beads.

Mica in polyurethane. The Micas are irregular shape particulates of natural occurrence. They are crystalling particles of Potassium, Magnesium, Aluminum, Vanadium, and Calcium silicates.

Wollastonite in polyurethane. They are crystalline fibers (needle like) of natural occurrence consisting of 50% $SiO_2$, 40% CaO, and 10% various metal oxides.

Glass fibers in polyurethane. The glass fibers are amorphous synthetic glass drawn into fibrous forms.

Basalt fibers in polyurethane. Basalt is a natural occurrence igneous rock. Basalt fibers are prepared in the laboratory by drawing the molten igneous rock at high temperature (1250° C.) into fibers of desired dimensions. The typical composition of Basalt is 55% $SiO_2$, 11% $Al_2O_3$, 22% $TiO_2$, and balanced of oxides of Fe, Mn, Mg, Ca, Na, and P.

All the inorganic fillers described above, as supplied by the manufactures, have particle size distribution from about 0.1 micrometer to about 10 micrometers. The glass fibers and the Basalt fibers chosen are cylindrically shaped short fibers having an aspect ratio (length to diameter ratio) of less than 10.

The particulate materials of the present invention are incorporated directly into the prepolymer liquid and can be present in the cleaning blade polymer matrix in a range between about 0.5 and 25 percent by weight. A loading range of from about 1 to about 10 percent by weight is preferred. However, if increasing the cleaning blades rigidity is a desired property, a higher filler loading level of up to 35 weight percent is feasible. The inorganic fillers of the invention give mechanical property reinforcement to the resulting cleaning blade, as reflected in the increase in wear resistance, tear roughness, and fatigue cracking as well as reducing the surface contact friction.

To improve wear and frictional properties for the elastomeric material cleaning blade, other micronized inorganic particles have hardness equal or exceeding 5 Mohs are also included in this invention. They include: Ground glass, Topaz, Corundum, zeosphere, Actinolite, Akermanite, Allanite, Almandine, Alumina, Amblygonite, Analcite, Anatase, Andalusite, Andesine, Andradite, Anorthite, Anthophyllite, Arsenopyrite, Augite, Axinite, baddoleyite, Benitoite, Bertrandite, beryl, beryllonite, bixbyite, Boracite, braunite, bravoite, Brookite, cancrinite, Cassiterite, Celsian, Chloritoid, Chondrodite, Chrysoberyl, Clinozoisite, Columbite, Cordierite, Cummingtonite, Danburite, Datolite, Diaspore, Diopside, Enstatite, Epidote, Euclasite, Eudialite, Euxenite, Fayalite, Fergussonite, Forsterite, Franklinite, Gahnite, Gehlenite, Geikielite, Glaucophane, Goethite, Grossularite, Hambergite, Hauyne, Hedenbergite, Helvite, Hematite, Hereynite, Hornblande, Humite, Hydrogrossularite, Ilmenite, Jadete, Kaliophyllite, Kyanite, Lazulite, Leuoite, Magnetite, Manganosite, Marcasite, Marialite, Meionite, Melilite, Microcline, Mesolite, Microlite, Monticellite, Natrolite, Nepheline, Nicolite, Noseon, Oligoclase, Olivine, Orthoclase, Orthopyroxene, Pectolite, Periclase, Pekorskite, Petalite, Phenakite, Piemontite, Pigeonite, Pollucite, Prehnite, Pseudobrookite, Psilomelane, Pumpellyite, Pyrite, Pyrochlore, Pyralusite, Pyrope, Rammelsbrite, Rhodonite, Rutile, Samarskite, Sapphirine, Scapolite, Schaelite, Sillimanite, Skutterudite, Sodalite, Sperrylite, Spessartite, Spodumane, Staurolite, Stibiotantalite, Tantalite, Tapiolite, Thomsonite, Thorianite, Tourmaline, Tremolite, Turquois, Ullmannite, Uranimite, Uvarovite, Vesuvianite, Wagnerite, Willemite, Wollastonite, Zircon, Zirconia, Zoisite, and synthetic glass sphere.

Other mineral particulates having lower hardness such as calcium carbonate (3.0 Mohs), Barium Carbonate (3.5 Mohs), Zincite (4.0 Mohs), Boehmite (4.0 Mohs), Gibbsite (3.0 Mohs), Anhydrite (3.5 Mohs) Gypsum (2.0 Mohs), Mica (2.5 Mohs) and Clay (2.0 Mohs) are also acceptable for this invention.

Satisfactory matrix materials for the cleaning blade include, liquid prepolymers that can wet the filler, generally having a viscosity less than about 60,000 c.p., and having an unfilled Young's modulus value in the range of 100–1200 psi including thermoset and thermoplastic elastomers. Known blade materials include, but are not limited to urethane resins, caprolactones, polyesters and polyethers, polysiloxane rubber, polytetrafluoroethylene resin, polytrifluorochloroethylene resin, styrenebutadiene rubber, nitrile rubber, nitrosilicone rubber, polyethylene rubber and blends and mixtures and copolymers thereof.

Although the invention has been described with reference to specific preferred embodiments, it is not intended to be limited thereto. Rather, those skilled in the art will recognize that variations and modifications may be made therein which are within the spirit of the invention and the scope of the claims.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

COMPARATIVE EXAMPLE I

A control test polyurethane sample was fabricated by casting the liquid Q-Thane KR-4780 over a 200 Angstrom Titanium/3-mil. Polyethylene terephthalate (PET) supporting substrate, using a 6 mil. gap bird applicator. The wet cast film, consisting of 35 weight percent polyurethane dissolved in 65 weight percent toluene, was dried at 135° C. for 5 minutes in an air circulating oven to yield a cross linked elastomeric coating of about 2 mils. in dry thickness. The reasons that this aliphatic polyurethane was chosen for the present invention concept demonstration are:

(1.) The cured elastomer of this polyurethane has mechanical properties about equivalent to those of a polyurethane cleaning blade material, (2.) Ease of experimental sample preparation for invention fillers incorporation, and (3.) It is a system catalytically cured by the moisture present in the air and the curing process is accelerated at elevated temperature. At 135° C. the material will be completely cured into an elastomer in 3 minutes.

EXAMPLE II

Invention polyurethane test samples were fabricated by following the same procedures and using the same material as described in COMPARATIVE EXAMPLE I, except that microcrystalline silica was incorporated to yield 3 weight percent in the resulting cured sample. The dispersion of microcrystalline silica in the polyurethane solution was carried out first by direct addition of the silica to the solution. With the aid of a high shear blade disperser (Tekmar Dispax Dispersator), the particles were dispersed in the solution inside a water cooled; jacketed container to prevent the solution from overheating and loosing solvent due to evaporation prior to solution casting.

The microcrystalline silica, available from Malvern Minerals Company, is irregularly shaped hard quartz particles of natural occurrence. Having a hardness of 7.0 Mohs, the particles have inherent wear resistant property. The microcrystalline silica, as is mined, has a particle size range from about 0.1 micrometer to about 8 micrometers. They are classified to give a particle size range between about 0.1 micrometer and 4.9 micrometers with an average particle size of about 2.5 micrometers. Alternate forms of the microcrystalline silica which can be used for the present invention sample preparation are christobalite and tridymite.

EXAMPLE III

Invention polyurethane test sample was fabricated by following the same procedures and using the materials as described in EXAMPLE II, except that the microcrystalline silica dispersion in the cured sample is 5 weight percent.

EXAMPLE IV

Invention polyurethane test sample was fabricated by following the same procedures and using the same materials as described in EXAMPLE II, except that the microcrystalline silica had been surface treated with a bi-functional silane coupling agent, $NH_2(CH_2)_3$-Si-$(OC_2H_5)_3$ (3-aminopropyl triethoxy silane), prior to addition to the polyurethane solution. The surface treated microcrystalline silica dispersion in the resulting cured polyurethane test sample is 3 weight percent.

Although the micro-crystalline silica particles treated with the bi-functional silane coupling agent are commercially available from Malvern Minerals Company, any suitable technique may be utilized to treat the crystalline particles with the reaction product of the hydrolyzed silane. For example, washed crystalline silica can be swirled in a hydrolyzed silane solution for between about 1 minute and about 60 minutes and then the solids there after allowed to settle out and remain in contact with the hydrolyzed silane for between about b 1 minute and about 60 minutes. The supernatent liquid may then be decanted and the treated crystalline silica filtered with filter paper. The crystalline silica may be dried at between about 1 minute and about 60 minutes at between about 80° C. and about 165° C. in a forced air oven for between about 1 minute and about 60 minutes. If desired, hydrolysis of the silane may be effected at the surface of the microcrystalline silica surface as described for example, in Example 2 of U.S. Pat. No. 3,915,735.

EXAMPLE IV

Invention polyurethane test sample was fabricated by following the same procedures and using the same materials as described in EXAMPLE IV, except that the surface treated microcrystalline silica dispersion in the cured sample is 5 weight percent.

EXAMPLE VI

Invention polyurethane test sample was fabricated by following the same procedures and using the same materials as described in EXAMPLE II, except that the microcrystalline silica is substituted by zeeospheres type X-60, available from Zeelan Industries Inc. The zeeospheres are spherical shaped inert ceramic particles. They are hollow spheres with thick walls and having a hardness of 7 Mohs. The loading level in the cured polyurethane sample is 3 weight percent.

EXAMPLE VII

Invention polyurethane test sample was fabricated by following the same procedures and using the same materials as described in EXAMPLE VI, except that the zeeospheres content in the cured polyurethane sample is 5 weight percent.

EXAMPLE VIII

The invention elastomeric polyurethane test samples of EXAMPLES II through VII were evaluated for coefficient of surface contact friction against the charge transport layer of a photoconductive imaging member. The test sample of COMPARATIVE EXAMPLE I was also evaluated along to serve as a control.

The coefficient of the surface contact friction test was conducted by fastening the photoconductive imaging member, with its charge transport layer facing up, to a platform surface. A polyurethane test sample of COMPARATIVE EXAMPLE I was then secured to the flat surface of the bottom of a horizontally sliding plate weighing 200 grams. The sliding plate is dragged in a straight line over the platform, against the horizontal charge transport layer surface of the photoconductive imaging member, with the outer surface of the polyurethane facing downwardly. The sliding plate was moved by a cable which has one end attached to the plate and the other end threaded around a low friction pulley and fastened to the Instron Tensile Tester. The pulley is positioned so that the segment of the cable between the weight and the pulley is parallel to the surface of the flat horizontal test surface. The cable was pulled vertically upward from the pulley by the Instron Tensile Tester. The coefficient of surface contact friction was calculated by dividing the load which is required to pull the sliding plate by 200 grams.

The coefficient of surface contact friction measurement against a fresh charged transport layer surface of a new photoconductive imaging member was repeated again by replacing the polyurethane sample of COMPARATIVE EXAMPLE I with each of the invention polyurethane samples of EXAMPLES II through VII. The results presented in TABLE I below, show that inorganic fillers incorporated in an elastomeric polyurethane can substantially reduce its coefficient of surface contact friction against the charge transport layer of the photoconductive imaging member.

TABLE I

| EXAMPLE | Filler Loading | Coefficient of Friction Static | Dynamic |
|---|---|---|---|
| I, Control | None | 4.6 | 1.5 |
| II | 3% silica | 3.2 | 0.9 |
| III | 5% silica | 2.6 | 0.8 |
| IV | 3% silane treated silica | 3.1 | 0.9 |
| V | 5% silane treated silica | 2.6 | 0.8 |
| VI | 3% zeosphere | 3.0 | 0.9 |
| VII | 5% zeosphere | 2.4 | 0.8 |

EXAMPLE IX

The invention elastomeric polyurethane test samples of EXAMPLES II through VII along with the control sample of COMPARATIVE EXAMPLE I were tested for wear resisting properties as a result of filler incorporation.

Wear testing is effected by means of a dynamic mechanical cycling device in which glass tubes are skidded across the surface of the polyurethane test sample of each example. More specifically, one end of the test sample is clamped to a stationary post and the sample is looped upward over three equally spaced horizontal glass tubes and then downwardly over a stationary guide tube through a generally inverted "U" shaped path with the free end of the sample secured to a weight which provides one pound per inch width tension on the sample. The face of the test sample bearing the polyurethane elastomer is facing downward such that it is allowed to contact the glass tubes. The glass tubes have a diameter of 1 inch. Each tube is secured at each end to an adjacent vertical surface of a pair of disks that are rotatable about a shaft connecting the centers of the disks. The glass tubes are parallel to and equidistant from each other and equidistant from the shaft connecting the centers of the disks. Although the disks are rotated about the shaft, each glass tube is rigidly secured to the disk to prevent rotation of the tubes around each individual tube axis. Thus, as the disk rotates about the shaft, two glass tubes are maintained at all times in sliding contact with the surface of the polyurethane sample. The axis of each glass tube is positioned about 4 cm. from the shaft. The direction of movement of the glass tubes along the polyurethane surface is away from the weighted end of the sample toward the end clamped to the stationary post. Since there are three glass tubes in the test device, each complete rotation of the disk is equivalent to three wear cycles in which the surface of the polyurethane elastomer is in sliding contact with a single stationary support tube during testing. The rotation of the spinning disk is adjusted to provide the equivalent of 11.3 inches per second tangential speed. The extend of the polyurethane wear is measured using a permascope after 90,000 wear cycles of testing. The wear results obtained are listed in the following:

TABLE II

| EXAMPLE | Filler Loading | Amount of Polyurethane Wear (micrometers) |
|---|---|---|
| I, Control | None | 41 |
| II | 3% silica | 27 |
| III | 5% silica | 16 |
| IV | 3% silane treated silica | 26 |
| V | 5% silane treated silica | 15 |
| VI | 3% zeosphere | 28 |
| VII | 5% zeosphere | 19 |

These data indicate that inorganic filler incorporation in the polyurethane elastomer could produce an outstanding wear resistance result. At 5 percent by weight loading, the wear improvement was about 3 times over the control polyurethane counterpart.

In recapitulation, it is evident that the cleaning blade of the present invention includes the incorporation of homogeneously dispersed inorganic particles in the elastomeric matrix of the blade. The reinforcement effect of the filler incorporation improves the blade's wear resistance and tear toughness, as well as reducing its contact friction against a charge retentive surface of an electrophotographic imaging member while maintaining good conformance in the lateral direction.

It is, therefore, apparent that there has been provided in accordance with the present invention, an elastomeric blade with particulate filler that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A cleaning blade in frictional engagement with a surface and being adapted to remove particles therefrom, comprising:

a blade body made from a thermoset elastomeric matrix material; and an inorganic particulate filler material for wear resistance, having a hardness ranging from about 4 Mohs to 7 Mohs, dispersed in the thermoset elastomeric matrix material of said blade body.

2. A cleaning blade as recited in claim 1, wherein said inorganic particulate filler material has an aspect ratio of less than 10:1.

3. A cleaning blade as recited in claim 1, wherein said thermoset elastomeric matrix material is chosen from a group of materials consisting of polyurethane, caprolactones, polyesters and polyethers.

4. A cleaning blade as recited in claim 3, wherein said particulate filler material is substantially dispersed homogeneously throughout said thermoset elastomeric matrix material.

5. A cleaning blade as recited in claim 1, wherein said inorganic particulate filler material has a mean particle size of about 2.5 micrometers.

6. A cleaning blade as recited in claim 1, wherein said inorganic particulate filler is selected from a group of materials consisting of micro-crystalline silica, fine glass spheres, Wollastonite, glass fibers, Basalt fibers, ground glass, Topaz, Corundum, zeosphere, Actinolite, Akermanite, Allanite, Almandine, Alumina, Amblygonite, Analcite, Anatase, Andalusite, Andesine, Andradite, Anorthite, Anthophyllite, Arsenopyrite, Augite, Axinite, baddoleyite, Benitoite, Bertrandite, beryl, beryllonite, bixbyite, Boracite, braunite, bravoite, Brookite, cancrinite, Cassiterite, Celsian, Chloritoid, Chondrodite, Chrysoberyl, Clinozoisite, Columbite, Cordierite, Cummingtonite, Danburite, Datolite, Diaspore, Diopside, Enstatite, Epidote, Euclasite, Eudialite, Euxenite, Fayalite, Fergussonite, Forsterite, Franklinite, Gahnite, Gehlenite, Geikielite, Glaucophane, Goethite, Grossularite, Hambergite, Hauyne, Hedenbergite, Helvite, Hematite, Hereynite, Hornblande, Humite, Hydrogrossularite, Ilmenite, Jadete, Kaliophyllite, Kyanite, Lazulite, Leuoite, Magnetite, Manganosite, Marcasite, Marialite, Meionite, Melilite, Microcline, Mesolite, Microlite, Monticellite, Natrolite, Nepheline, Nicolite, Noseon, Oligoclase, Olivine, Orthoclase, Orthopyroxene, Pectolite, Periclase, Pekorskite, Petalite, Phenakite, Piemontite, Pigeonite, Pollucite, Prehnite, Pseudobrookite, Psilomelane, Pumpellyite, Pyrite, Pyrochlore, Pyralusite, Pyrope, Rammelsbrite, Rhodonite, Rutile, Samarskite, Sapphirine, Scapolite, Schaelite, Sillimanite, Skutterudite, Sodalite, Sperrylite, Spessartite, Spodumane, Staurolite, Stibiotantalite, Tantalite, Tapiolite, Thomsonite, Thorianite, Tourmaline, Tremolite, Turquois, Ullmannite, Uranimite, Uvarovite, Vesuvianite, Wagnerite, Willemite, Wollastonite, Zircon, Zirconia, Zoisite, barium carbonate, clay, Zincite, Boehmite, Gibbsite, Anhydrite and Gypsum.

7. A cleaning blade in frictional engagement with a surface and being adapted to remove particles therefrom, comprising:

a blade body made from a thermoset elastomeric matrix material; and an inorganic particulate filler material dispersed in the thermoset elastomeric matrix material of said blade body, wherein said inorganic particulate filler is selected from the group consisting of micro-crystalline silica, fine glass spheres, Mica, Wollastonite, glass fibers, Basalt fibers, ground glass, Topaz, Corundum, zeosphere, Actinolite, Akermanite, Allanite, Almandine, Alumina, Amblygonite, Analcite, Anatase, Andalusite, Andesine, Andradite, Anorthite, Anthophyllite, Arsenopyrite, Augite, Axinite, baddoleyite, Benitoite, Bertrandite, beryl, beryllonite, bixbyite, Boracite, braunite, bravoite, Brookite, cancrinite, Cassiterite, Celsian, Chloritoid, Chondrodite, Chrysoberyl, Clinozoisite, Columbite, Cordierite, Cummingtonite, Danburite, Datolite, Diaspore, Diopside, Enstatite, Epidote, Euclasite, Eudialite, Euxenite, Fayalite, Fergussonite, Forsterite, Franklinite, Gahnite, Gehlenite, Geikielite, Glaucophane, Goethite, Grossularite, Hambergite, Hauyne, Hedenbergite, Helvite, Hematite, Hereynite, Hornblande, Humite, Hydrogrossularite, Ilmenite, Jadete, Kaliophyllite, Kyanite, Lazulite, Leuoite, Magnetite, Manganosite, Marcasite, Marialite, Meionite, Melilite, Microcline, Mesolite, Microlite, Monticellite, Natrolite, Nepheline, Nicolite, Noseon, Oligoclase, Olivine, Orthoclase, Orthopyroxene, Pectolite, Periclase, Pekorskite, Petalite, Phenakite, Piemontite, Pigeonite, Pollucite, Prehnite, Pseudobrookite, Psilomelane, Pumpellyite, Pyrite, Pyrochlore, Pyralusite, Pyrope, Rammelsbrite, Rhodonite, Rutile, Samarskite, Sapphirine, Scapolite, Schaelite, Sillimanite, Skutterudite, Sodalite, Sperrylite, Spessartite, Spodumane, Staurolite, Stibiotantalite, Tantalite, Tapiolite, Thomsonite, Thorianite, Tourmaline, Tremolite, Turquois, Ullmannite, Uranimite, Uvarovite, Vesuvianite, Wagnerite, Willemite, Wollastonite, Zircon, Zirconia, Zoisite, Wollastonite, glass fibers, and Basalt fibers and said selected inorganic filler having a cylindrical shape of from about 1 to about 3 micrometers in mean diameter and from about 3 to about 10 micrometers in length.

8. A cleaning blade as recited in claim 7, wherein said inorganic particles are surface treated with a coupling agent.

9. A cleaning blade as recited in claim 8, wherein said coupling agent includes silanes, titanates, zirconates and aluminates.

* * * * *